US008246914B2

(12) United States Patent
Mehlberg et al.

(10) Patent No.: US 8,246,914 B2
(45) Date of Patent: Aug. 21, 2012

(54) FLUID CATALYTIC CRACKING SYSTEM

(75) Inventors: Robert L. Mehlberg, Wheaton, IL (US); Keith Allen Couch, Arlington Heights, IL (US); Brian W. Hedrick, Oregon, IL (US); Zhihao Fei, Naperville, IL (US)

(73) Assignee: UOP LLC, Des Plaines, IL (US)

( * ) Notice: Subject to any disclaimer, the term of this patent is extended or adjusted under 35 U.S.C. 154(b) by 447 days.

(21) Appl. No.: 12/340,945

(22) Filed: Dec. 22, 2008

(65) Prior Publication Data

US 2010/0158767 A1 Jun. 24, 2010

(51) Int. Cl.
*B01J 8/24* (2006.01)
*C07C 4/06* (2006.01)

(52) U.S. Cl. ..... 422/139; 422/622; 422/234; 585/648; 585/651; 585/653; 208/72

(58) Field of Classification Search ..... 422/139, 422/622, 234; 585/648–651, 653; 208/72
See application file for complete search history.

(56) References Cited

U.S. PATENT DOCUMENTS

| | | | | |
|---|---|---|---|---|
| 2,970,100 | A | | 1/1961 | Mortiz |
| 3,347,778 | A | | 10/1967 | Dill et al. |
| 3,470,084 | A | | 9/1969 | Scott |
| 3,520,797 | A | | 7/1970 | Payne et al. |
| 3,758,403 | A | * | 9/1973 | Rosinski et al. ..... 502/67 |
| 3,928,172 | A | | 12/1975 | Davis, Jr. et al. |
| 4,090,948 | A | | 5/1978 | Schwarzenbek |
| 4,479,870 | A | | 10/1984 | Hammershaimb et al. |
| 4,717,466 | A | | 1/1988 | Herbst et al. |
| 4,831,204 | A | | 5/1989 | Kushnerick et al. |
| 4,861,741 | A | | 8/1989 | Herbst et al. |
| 4,892,643 | A | | 1/1990 | Herbst et al. |
| 4,922,048 | A | | 5/1990 | Harandi |
| 4,961,907 | A | | 10/1990 | Herbst et al. |
| 4,966,681 | A | | 10/1990 | Herbst et al. |
| 5,154,818 | A | | 10/1992 | Harandi et al. |
| 5,288,920 | A | | 2/1994 | Chan et al. |
| 5,389,232 | A | | 2/1995 | Adewuyi et al. |
| 5,435,906 | A | | 7/1995 | Johnson et al. |
| 5,451,313 | A | | 9/1995 | Wegerer et al. |
| 5,538,625 | A | * | 7/1996 | Sigaud et al. ..... 208/127 |
| 5,565,176 | A | | 10/1996 | Johnson et al. |

(Continued)

FOREIGN PATENT DOCUMENTS

CN 1403540 A 3/2003

(Continued)

OTHER PUBLICATIONS

Abul-Hamayel et al., Enhancement of Propylene Production in a Downer FCC Operation Using a ZSN-5 Additive, Chemical Engineering & Technology, 2005, vol. 28(8), pp. 923-929.

(Continued)

*Primary Examiner* — Jennifer A Leung
(74) *Attorney, Agent, or Firm* — James C Paschall

(57) ABSTRACT

One exemplary embodiment can be a fluid catalytic cracking system. The system can include a reaction zone operating at conditions to facilitate olefin production and including at least one riser. The at least one riser can receive a first feed having a boiling point of about 180-about 800° C., and a second feed having more than about 70%, by weight, of one or more $C4^+$ olefins.

10 Claims, 7 Drawing Sheets

U.S. PATENT DOCUMENTS

| | | | | |
|---|---|---|---|---|
| 5,616,237 | A | 4/1997 | Krishna et al. | |
| 5,730,859 | A | 3/1998 | Johnson et al. | |
| 5,843,377 | A | 12/1998 | Fandel et al. | |
| 5,846,403 | A | 12/1998 | Swan et al. | |
| 5,981,819 | A | 11/1999 | Moeller et al. | |
| 5,997,728 | A | 12/1999 | Adewuyi et al. | |
| 6,093,867 | A | 7/2000 | Ladwig et al. | |
| 6,106,697 | A | 8/2000 | Swan et al. | |
| 6,123,832 | A | 9/2000 | Ho et al. | |
| 6,156,189 | A | 12/2000 | Ho et al. | |
| 6,222,087 | B1 | 4/2001 | Johnson et al. | |
| 6,287,522 | B1 | 9/2001 | Lomas | |
| 6,307,117 | B1 | 10/2001 | Tsunoda et al. | |
| 6,388,152 | B1 | 5/2002 | Ladwig et al. | |
| 6,455,750 | B1 | 9/2002 | Steffens et al. | |
| 6,489,530 | B1 | 12/2002 | Stuntz | |
| 6,646,175 | B1 | 11/2003 | Dath et al. | |
| 6,646,176 | B1 | 11/2003 | Dath et al. | |
| 6,660,812 | B2 | 12/2003 | Kuechler et al. | |
| 6,791,002 | B1 | 9/2004 | Abrevaya et al. | |
| 6,858,133 | B2 | 2/2005 | Dath et al. | |
| 6,953,872 | B1 | 10/2005 | Koss et al. | |
| 7,154,015 | B2 * | 12/2006 | Perego et al. | 585/648 |
| 7,247,233 | B1 | 7/2007 | Hedrick et al. | |
| 7,261,807 | B2 | 8/2007 | Henry et al. | |
| 7,312,370 | B2 | 12/2007 | Pittman et al. | |
| 7,491,315 | B2 * | 2/2009 | Eng et al. | 208/113 |
| 2001/0044565 | A1 | 11/2001 | Keady et al. | |
| 2002/0003103 | A1 | 1/2002 | Henry et al. | |
| 2002/0014438 | A1 | 2/2002 | Swan, III | |
| 2002/0189973 | A1 | 12/2002 | Henry et al. | |
| 2003/0062291 | A1 | 4/2003 | Dath et al. | |
| 2003/0149322 | A1 | 8/2003 | Koss et al. | |
| 2004/0079679 | A1 | 4/2004 | Gauthier et al. | |
| 2004/0112793 | A1 | 6/2004 | Dath et al. | |
| 2004/0182745 | A1 | 9/2004 | Chen et al. | |
| 2004/0182746 | A1 | 9/2004 | Chen et al. | |
| 2004/0182747 | A1 | 9/2004 | Chen et al. | |
| 2004/0258580 | A1 | 12/2004 | Abrevaya et al. | |
| 2005/0121361 | A1 | 6/2005 | Duplan et al. | |
| 2005/0150817 | A1 | 7/2005 | Tallman et al. | |
| 2005/0234282 | A1 | 10/2005 | Bach et al. | |
| 2006/0108260 | A1 | 5/2006 | Henry | |
| 2006/0108261 | A1 | 5/2006 | Steffens et al. | |
| 2006/0138027 | A1 | 6/2006 | Soni et al. | |
| 2006/0260981 | A1 | 11/2006 | Gosling | |
| 2006/0287561 | A1 | 12/2006 | Choi et al. | |
| 2007/0038010 | A1 | 2/2007 | Xie et al. | |
| 2007/0083071 | A1 | 4/2007 | Choi et al. | |
| 2007/0167662 | A1 | 7/2007 | Duplan et al. | |
| 2007/0205139 | A1 | 9/2007 | Kulprathipanja et al. | |
| 2007/0213573 | A1 | 9/2007 | Ross et al. | |
| 2007/0246400 | A1 | 10/2007 | Jens et al. | |
| 2007/0265482 | A1 | 11/2007 | Tsunoda et al. | |
| 2008/0035527 | A1 | 2/2008 | Eng et al. | |
| 2008/0093263 | A1 | 4/2008 | Cheng et al. | |
| 2009/0299119 | A1 * | 12/2009 | Claude et al. | 585/653 |

FOREIGN PATENT DOCUMENTS

| | | | |
|---|---|---|---|
| CN | 1506342 | A | 6/2004 |
| CN | 1506343 | A | 6/2004 |
| CN | 1600757 | A | 3/2005 |
| CN | 1611472 | A | 5/2005 |
| CN | 1676213 | A | 10/2005 |
| CN | 1704389 | A | 12/2005 |
| CN | 1762931 | A | 4/2006 |
| CN | 1912059 | A | 2/2007 |
| CN | 1912065 | A | 2/2007 |
| CN | 1915922 | A | 2/2007 |
| CN | 1915924 | A | 2/2007 |
| CN | 1915928 | A | 2/2007 |
| CN | 1915929 | A | 2/2007 |
| CN | 1915930 | A | 2/2007 |
| CN | 1915935 | A | 2/2007 |
| CN | 1927780 | A | 3/2007 |
| CN | 1927783 | A | 3/2007 |
| CN | 1962577 | A | 5/2007 |
| CN | 1978410 | A | 6/2007 |
| DE | 41 14874 | A1 | 11/1991 |
| DE | 41 14 874 | B4 | 2/2006 |
| EP | 0 381 870 | A1 | 8/1990 |
| EP | 0 921 176 | A1 | 6/1999 |
| WO | WO-99/55801 | | 11/1999 |
| WO | WO-99/55802 | | 11/1999 |
| WO | WO-00/40672 | | 7/2000 |
| WO | WO-2004/072002 | A1 | 8/2004 |
| WO | WO-2004/078881 | A1 | 9/2004 |
| WO | WO-2004/078882 | A1 | 9/2004 |
| WO | WO-2007/135055 | A1 | 11/2007 |
| WO | WO-2007/135058 | A1 | 11/2007 |

OTHER PUBLICATIONS

Buchanan, The Chemistry of Olefins Production by ZSM-5 Addition to Catalytic Cracking Units, Catalysis Today, 2000, vol. 55(3), pp. 207-212.

Buchanan et al., Effects of High Temperature and High ZSM-5 Additive Level on FCC Olefins Yields and Gasoline Composition, Applied Catalysis, A: General, 1996, vol. 134(2), pp. 247-262.

Chan et al., SCC Advanced FCCU Technology for Maximum Propylene Production, Hydrocarbon Asia, Oct. 1999, vol. 9/7, pp. 52-55.

Chan et al., SCC [(Selective Component Cracking)]: Advanced FCCU Technology for Maximum Propylene Production, AIChE 1999 Spring National Meeting, Preprint N. 40c, Mar. 1999, pp. 7 pages.

Abstract of 1403540 A published Mar. 19, 2003.

Abstract of CN 1506342 published Jun. 23, 2004.

Abstract of CN 1506343 published Jun. 23, 2004.

Abstract of CN 1600757 published Mar. 30, 2005.

Abstract of CN 1611472 published May 4, 2005.

Abstract of CN 1676213 published Oct. 5, 2005.

Abstract of CN 1704389 published Dec. 7, 2005.

Abstract of CN 1762931 published Apr. 26, 2006.

Abstract of 1912059 A published Feb. 14, 2007.

Abstract of CN 1912065 published Feb. 14, 2007.

Abstract of CN 1915922 published Feb. 21, 2007.

Abstract of CN 1915924 published Feb. 21, 2007.

Abstract of CN 1915928 published Feb. 21, 2007.

Abstract of CN 1915929 published Feb. 21, 2007.

Abstract of CN 1915930 published Feb. 21, 2007.

Abstract of CN 1915935 published Feb. 21, 2007.

Abstract of CN 1927780 published Mar. 14, 2007.

Abstract of CN 1927783 published Mar. 14, 2007.

Abstract of CN 1962577 published May 16, 2007.

Abstract of CN 1978410 published Jun. 13, 2007.

Corma et al., Light Cracked Naphtha Processing: Controlling Chemistry for Maximum Propylene Production, Catalysis Today, 2005, vol. 107-108, pp. 699-706.

Corma et al., Diff. Process Schemes for Converting Light Straight Run & Fluid Catalytic Cracking Naphthas in FCC Unit for Max. Propyl, Applied Catalysis, A: General, 2004, vol. 265(2), pp. 195-206.

Abstract of DE4114874A1 published Nov. 14, 1991.

Abstract of DE4114874B4 published Feb. 2, 2006.

Abstract and Graphics of Duan et. al., Studies on Light FCC Gasoline Recycling with Stratified Injection for Maximum Propylene Production, Shiyou Xuebao, Shiyou Jiagong, 2008, vol. 24(1), pp. 28-33.

Fu et al., Using ZSM-5 Additive with DMS Based (Distributed Matrix Structure) FCC Catalyst for Increased Propylene Production, Preprints-American Chemical Society, Division of Petroleum Chemistry, 2006, vol. 51(2), pp. 588-589.

Fujiyama et al. Processing: Demonstration Plant for New FCC Technology Yields Increased Propylene, Oil and Gas Journal, Sep. 26, 2005, vol. 103/36, pp. 54-58.

Hemler et al., Maximising FCC Propylene Production, Petroleum Technology Quarterly, Summer 1999, vol. 4, No. 2, pp. 31, 33-35.

Jakkula et al., Short Contact Time Catalytic Cracking Process—Results from Bench Scale Unit, Proceedings of the World Petroleum Congress 1998, 1998, vol. 15th(vol. 2), pp. 736-737.

James et al., The ATOFINA/UOP Olefin Cracking Process for Light Olefin Production, DGMK Tagungsbericht, 2004, vol. 2004-3, pp. 161-169.
Johnson et al., FCC Design for Maximum Olefin Production, NPRA 1993 Annual Meeting, vol. N.AM-93-51, p. 127.
Koss, Producing Propylene from Low Valued Olefins. The New Propylur Tech. Which Can Be Applied to Boost Propylene Yield . . . , International Journal of Hydrocarbon Engineering, May 1999, vol. 4, No. 5, pp. 66, 68.
Lesemann et al., Increasing FCC Propylene, Petroleum Technology Quarterly, Jan./Feb./Mar. 2006, vol. 11/1, pp. 53-57.
Li et al., Maximizing Propylene Yield by Two-Stage Riser Catalyic Cracking of Heavy Oil, Industrial & Engineering Chemisty Research, 2007, vol. 46(14), pp. 4914-4920.
Abstract and Graphics of Li et al., Two-Stage Riser Fluidized-Bed Catalytic Cracking Technology for Production of Propylene, Shiyou Huagong, 2006, vol. 35(8), pp. 749-753.
Li et al., Highly Selective Conversion of Olefin Components in FCC Gasoline to Propylene in Monolithic Catalytic Reactors, China Petroleum Processing and Petrochemical Technology, 2006, No. 3, pp. 21-25.
Abstract and Graphics of Liu et al., Application of LOSA-1 to Increase Propylene Production with FCC, Zhongwai Nengyuan, 2006, vol. 11(1), pp. 73-77.
Lomas et al., Improved Product Distributions Via Multiple Reaction Zones in Commercial FCC Units, 15th World Petroleum Congress Proceedings, 1998, vol. 2, pp. 728-729.
Lu et al., Exploratory Study on Upgrading 1-Butene Using Spent FCC Catalyst/Additive Under Simulated Conditions of FCCU's Stripper, Applied Catalysis, A: General, 2003 vol. 255(2) , pp. 345-347.
Meng et al., Reducing FCC Gasoline Olefin and Enhancing Propylene Yield with FDFCC Process, World Petroleum Congress Proceedings, 2006, vol. 2006, p. 7.
Ondrey, Further Scaleup for a 'downer' FCC Process, Chemical Engineering, Sep. 2007, vol. 114/9, p. 13.
Abstract and Graphics of Pan et al., Measures for Increasing Propylene Yield in ARGG Unit, Shiyou Lianzhi Yu Huagong, 2006, vol. 37(1), pp. 27-30.
Saeed et al., FCC 'Downer' Pilot Plant at KFUPM: A First Experience, 13th Annual Saudi-Japanese Symposium-Catalysts in Petroleum Refining and Petrochemicals, Proceedings, 2003, vol. 2003, pp. 112-123.
Sundaram et al., Propylene Production from Fluid Catalytic Cracking Process, Proceedings—Ethylene Producers Conference 1999, 1999, vol. 8, pp. 791-806.
Tallman et al., Special Report: Consider New Catalytic Routes for Olefins Production, Hydrocarbon Processing, Apr. 2008, vol. 87/4, pp. 95-96, 98, 100-101.
Abstract and Graphics of Tang et al., Thermodynamic Analysis of Propylene-Enhancing FCC Process, Shiyou Xuebao, Shiyou Jiagong, 2008, vol. 24(1), pp. 22-27.
Abstract and Graphics of Tang et al., Commercial Application of Flexible Dual-Riser Fluid Catalytic Cracking Process, 2003, Lianyou Jishu Yu Gongcheng, vol. 33(3), pp. 15-18.
Tang et al., Commercial Test of Flexible Dual-Riser Catalytic Cracking Process, China Petroleum Processing and Petrochemical Technology, 2003, vol. (1), pp. 29-33.
Verstraete et al., Study of Direct and Indirect Naphtha Recycling to a Resid FCC Unit for Maximum Propylene, Catalysis Today, 2005, vol. 106(1-4), pp. 62-71.
Wang et al., New FCC Process Minimizes Gasoline Olefin, Increases Propylene, Oil & Gas Journal, 2003, vol. 101(6), pp. 52-53, 56-58.
Ware et al., Special Focus [on] Catalysts/Maximizing Refinery Propylene Production Using ZSM-5 Technology, Fuel Technology & Management, May 1998, vol. 8, No. 4, pp. 41-46.
Abstract of WO/2004072002 published Aug. 26, 2004.
Abstract and Graphics of Xu et al., Study on Effect of Catalyic Cracking Reaction Patterns and Their Interaction on Product Slate and Product Composition, Shiyou Lianzhi Yu Huagong, 2005, vol. 36(11), pp. 49-53.
Yang et al., Flexible Dual-Riser Fluid Catalytic Cracking Process and its Industry Application, Huaxue Gongye Yu Gongcheng Jishu, 2005, vol. 26(5), pp. 1-4.
Abstract of Yang et al., Flexible Dual-Riser Fluid Catalytic Cracking Process and its Industry Application, Huaxue Gongye Yu Gongcheng Jishu, 2005, vol. 26(5), pp. 1-4.
Yu et al., Commercial Practice on Technology for High-Temperature Cracking of C4 Fraction to Increase Propylene Yield, China Petroleum Processing and Petrochemical Technology, 2003, No. 3, pp. 29-32.
Abstract and Graphics of Zhang et al., Catalytic Conversion of Catalytic Cracking C4 Hydrocarbon to Propylene, Shiyou Huagong, 2005, vol. 34(8), pp. 714-718.

* cited by examiner

FLUID CATALYTIC CRACKING SYSTEM

FIELD OF THE INVENTION

This invention generally relates to fluid catalytic cracking systems, such as those receiving at least one of a hydrocarbon feed and a hydrocarbon stream.

DESCRIPTION OF THE RELATED ART

Catalytic cracking can create a variety of products from larger chain hydrocarbons. Often, a heavier hydrocarbon feed, such as a vacuum gas oil, is provided to a catalytic cracking reactor, such as a fluid catalytic cracking reactor. Various products can be obtained from such a system, including a gasoline product and/or other light products, such as ethylene and propylene.

In such systems, it is generally desirable to obtain more of certain products, such as ethylene and propylene. Particularly, ethylene and propylene can be used in subsequent products to manufacture, e.g., plastics. However, the desire to maximize the yield of light olefins can be limited due to process constraints, such as undesirable side reactions. Thus, it would be advantageous to provide a system and/or process that overcomes these deficiencies and allows the increased yield of light olefins.

SUMMARY OF THE INVENTION

One exemplary embodiment can be a fluid catalytic cracking system. The system can include a reaction zone operating at conditions to facilitate olefin production and including at least one riser. The at least one riser can receive a first feed having a boiling point of about 180-about 800° C., and a second feed having more than about 70%, by weight, of one or more $C4^+$ olefins.

Another exemplary embodiment can be a fluid catalytic cracking system. The system may include a reaction zone having at least one riser receiving a mixture of a first catalyst having pores with openings greater than about 0.7 nm and a second catalyst having smaller openings than the first catalyst, a naphtha stream including about 20-about 70%, by weight, one or more C5-C10 olefin compounds, a C4 hydrocarbon stream, and a feed stream having a boiling point of about 180-about 800° C.

Yet another exemplary embodiment can be a fluid catalytic cracking system. The system can include a reaction zone including a riser receiving a mixture of Y-zeolite and ZSM-5 zeolite, a feed having a boiling point of about 180-about 800° C., and an olefin stream including at least about 10%, by weight, one or more C4-C7 olefin compounds downstream of the mixture and the feed; a disengagement zone for separating the mixture from one or more reaction products; and a separation zone for recovery of the one or more reaction products.

Thus, the embodiments disclosed herein can provide systems and/or processes that can increase light olefin yield, particularly propylene. As an example, utilizing upper injection points or particular feeds can produce additional olefins. Regarding the injection points, such an arrangement can reduce residence time for converting the feed to facilitate olefin production. Moreover, recycling or providing certain streams to the riser can also facilitate the production of one or more desired products.

DEFINITIONS

As used herein, the term "stream" can be a stream including various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated C1, C2, C3 . . . Cn where "n" represents the number of carbon atoms in the one or more hydrocarbon molecules. In addition, paraffin molecules may be abbreviated with a "P", such as "C3P", which can represent propane. Moreover, olefin molecules may be abbreviated with an "=", such as C3=, which can represent propylene. Furthermore, a superscript "+" or "−" may be used with an abbreviated one or more hydrocarbons notation, e.g., $C3^+$ or $C3^-$, which is inclusive of the abbreviated one or more hydrocarbons. As an example, the abbreviation "$C3^+$" means one or more hydrocarbon molecules of three carbon atoms and/or more.

As used herein, the term "butene" can collectively refer to 1-butene, cis-2-butene, trans-2-butene, and/or isobutene.

As used herein, the term "amylene" can collectively refer to 1-pentene, cis-2-pentene, trans-2-pentene, 3-methyl-1-butene, 2-methyl-1-butene, and/or 2-methyl-2-butene.

As used herein, the term "rich" can mean an amount of generally at least about 50%, and preferably about 70%, by mole, of a compound or class of compounds in a stream.

As used herein, the term "pure" can mean at least about 99%, by mole, of a substance or compound.

As used herein, the term "downstream" generally means a location spaced apart from another location in the direction of a flow of a stream. As an example, a first point that is at a higher elevation on a riser than a second point would be downstream from the second point if an upward flowing feed is provided at the bottom of the riser.

DETAILED DESCRIPTION

Figure 1:
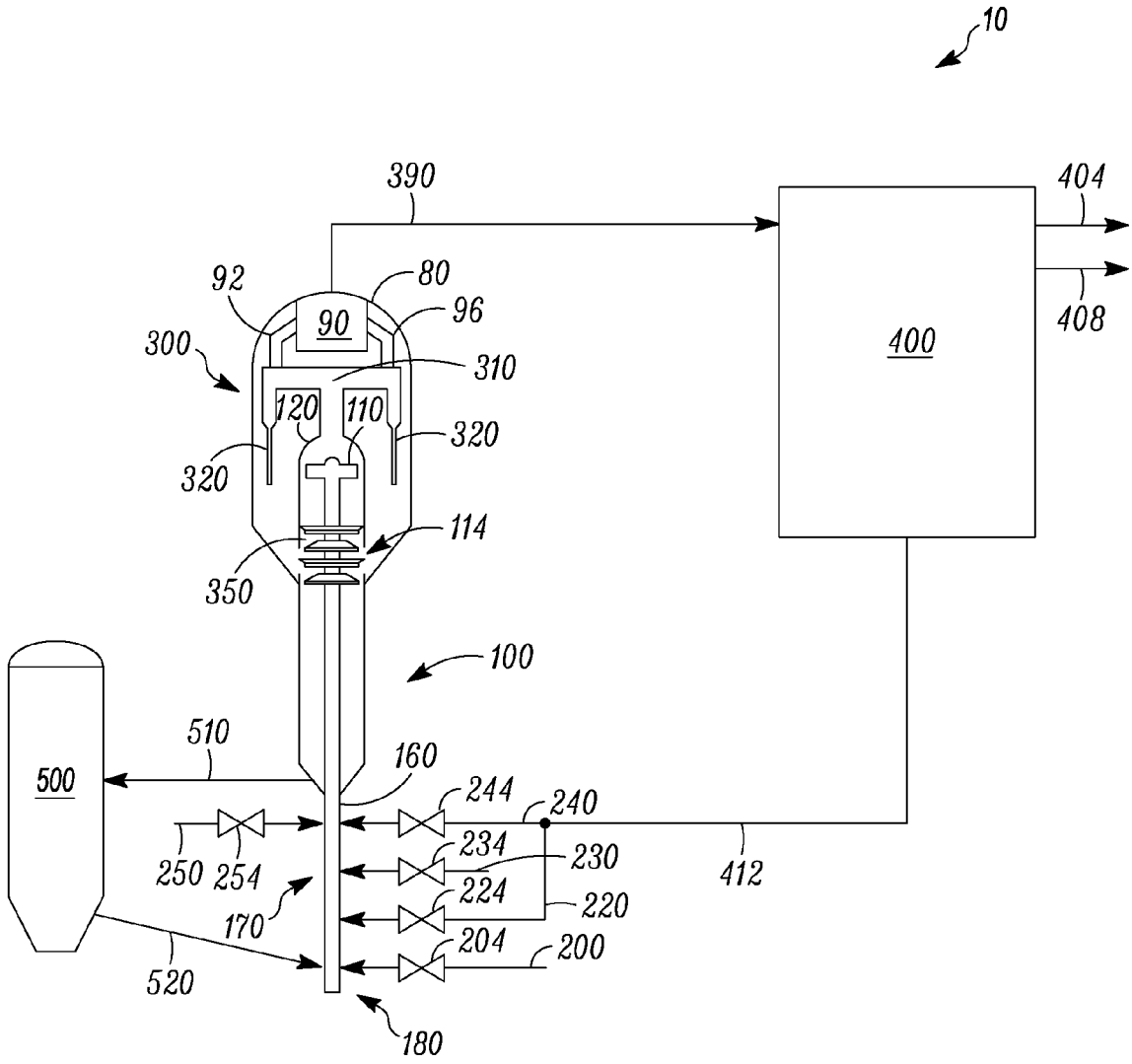
FIG. 1 is a schematic depiction of an exemplary fluid catalytic cracking system.

Referring to FIG. 1, a fluid catalytic cracking (hereinafter may be abbreviated "FCC") system 10 can include a reaction zone 100, a disengagement zone 300, a separation zone 400, and a regeneration zone 500. Generally, the reaction zone 100 can include a reaction vessel 120 and at least one riser 160, which can have multiple injection points for receiving hydrocarbon streams. Moreover, process flow lines in the figures can be referred to as lines, pipes, conduits, feeds or streams. Particularly, a line, a pipe, or a conduit can contain one or more feeds or streams, and one or more feeds or streams can be contained by a line, a pipe, or a conduit.

In this exemplary fluid catalytic cracking system 10, one or more upper injection points 170, such as a second feed point 170, can be used in conjunction with one or more lower injection points 180, such as a first feed point 180, e.g., with a first feed 200. Namely, several streams 200, 220, 230, 240, and 250 can be, independently, provided to the at least one riser 160 by opening or shutting, independently, respective valves 204, 224, 234, 244, and 254. The locations of the injection points can be optimized based on the composition of the hydrocarbon streams, operating conditions of the reaction zone 100, and the activity level of the second catalyst.

In one exemplary embodiment, opening the valve 204 can provide a first feed 200 having a boiling point of about 180-about 800° C. to the at least one riser 160. In addition, opening the valve 224 can provide a second feed 220 from the separation zone 400 having an effective amount of one or more $C4^+$ olefins and being above the first feed 200. Generally, the valves 234, 244, and 254 are closed.

Usually, the second feed 220 is provided above the first feed 200, and hence, has a shorter residence time. Particularly, the second feed 220 can include an effective amount of one or more $C4^+$ olefins for making propylene, such as more than about 10%, about 20%, about 30%, about 70%, about 80%, and even more than about 90%, by weight (may be abbreviated hereinafter "wt. %"), of one or more $C4^+$ olefins, e.g., C4-C12, preferably C3-C7 olefins. Typically, butene and/or hexene are particularly preferred. Generally, the second feed 220 can have a residence time of less than about 1 second and can be injected downstream of the first feed 200. The first feed 200 can be any suitable hydrocarbon stream, such as an atmospheric residue or a vacuum gas oil.

In an alternative embodiment, several feed streams can be provided to the at least one riser 160. In this exemplary embodiment, the valve 204 can be closed as well as the valve 224. Opening the valve 234 can provide a naphtha stream 230, including one or more C5-C10 hydrocarbons. Typically, the naphtha stream 230 can include about 15-about 70%, preferably about 20-about 70%, by weight, of one or more olefins. In addition, the naphtha stream can have a boiling point of about 15-about 225° C., preferably about 15-about 150° C. In addition, opening a valve 254 can provide a hydrocarbon stream 250 having a boiling point of about 180-about 800° C., such as an atmospheric residue or a vacuum gas oil. What is more, opening the valve 244 can provide an FCC C4 stream, such as a third feed 240 containing butenes, namely at least about 20 wt. %, preferably about 50-about 70 wt. % from the separation zone 400. In one exemplary embodiment, the third feed 240 can include a naphtha stream including oligomerized light olefins, such as butenes. In such a naphtha stream, the olefin content can be no less than about 70 wt. %, or even no less than about 90 wt. %.

What is more, other feed combinations can be provided to the at least one riser 160, such as closing the valve 244 and opening the valve 224 to inject the naphtha stream 230 downstream of the first feed 200. Independently, the valve 254 can be closed and the valve 204 can be opened to provide the stream 200 with the streams 220, 230, and/or 240. In yet another embodiment, the valves 224, 234, 244, and 254 can be closed, and the first feed 200 can be provided through the valve 204 with an FCC C4 stream and/or a naphtha stream providing, at least in part, fluidization of the stream 200.

Generally, it is desirable to provide, independently, the lighter feeds, namely feeds 220, 230, and 240, in a gas phase. Typically, these feeds 220, 230, and 240 can include at least about 50%, by mole, of the components in a gas phase. Preferably, the entire feeds 220, 230, and 240, i.e., at least about 99%, by mole, are in a gas phase. Generally, the temperature of the feeds 220, 230, and 240 can be, independently, about 120-about 500° C. Preferably, the temperature of the feeds 220, 230, and 240 are, independently, no less than about 320° C.

In addition, feed injection points can be provided on any suitable location on the at least one riser 160, such as proximate to a stripping zone 350, and downstream of the lines 250 and 240 and proximate to swirl arms 110, as hereinafter described. Generally, any suitable location on the riser 160 can be utilized to obtain the desired residence time. Furthermore, although one riser 160 is disclosed, it should be understood that multiple risers could be utilized, such as one riser having a shorter length and utilizing a shorter residence time for producing lighter olefinic species.

The reaction zone 100 can operate at any suitable conditions, such as a temperature of about 510-about 630° C., preferably about 530-about 600° C. Alternatively, the reaction zone 100 can operate at no less than about 500° C., preferably no less than about 550° C. In addition, any suitable pressure can be utilized such as less than about 450 kPA, preferably about 110-about 450 kPA, and optimally about 110-about 310 kPA. Furthermore, the reaction zone 100 may be operated at a low hydrocarbon partial pressure. Particularly, the hydrocarbon partial pressure can be about 35-about 180 kPA, preferably about 60-about 140 kPA. Alternatively, the hydrocarbon partial pressure can be less than about 180 kPA, such as less than about 110 kPA, or preferably less than about 70 kPA. In one exemplary embodiment, the hydrocarbon partial pressure can be about 5-about 110 kPA. Furthermore, the at least one riser 160 can provide a variety of points for receiving various hydrocarbon streams for producing products, such as propylene, as discussed in further detail hereinafter.

Relatively low hydrocarbon partial pressures can be achieved by using steam or other dilutants, such as a dry gas. Typically, the dilutant can be about 10-about 55 wt. % of the feed, preferably about 15 wt. % of the feed. Any suitable catalytic cracking catalyst, alone or combined with other catalyst, can be utilized in the at least one riser 160.

One suitable exemplary catalyst mixture can include two catalysts. Such catalyst mixtures are disclosed in, e.g., U.S. Pat. No. 7,312,370 B2. Generally, the first catalyst may include any of the well-known catalysts that are used in the art of FCC, such as an active amorphous clay-type catalyst and/or a high activity, crystalline molecular sieve. Zeolites may be used as molecular sieves in FCC processes. Preferably, the first catalyst includes a large pore zeolite, such as a Y-type zeolite, an active alumina material, a binder material, including either silica or alumina, and an inert filler such as kaolin.

Typically, the zeolitic molecular sieves appropriate for the first catalyst have a large average pore size. Usually, molecular sieves with a large pore size have pores with openings of greater than about 0.7 nm in effective diameter defined by greater than 10, and typically 12, member rings. Pore Size Indices of large pores can be above about 31. Suitable large pore zeolite components may include synthetic zeolites such as X and Y zeolites, mordent and faujasite. Y zeolites with a rare earth content of no more than about 1.0 wt. % rare earth oxide on the zeolite portion of the catalyst may be preferred as the first catalyst.

The second catalyst may include a medium or smaller pore zeolite catalyst exemplified by ZSM-5, ZSM-11, ZSM-12, ZSM-23, ZSM-35, ZSM-38, ZSM-48, and other similar materials. Other suitable medium or smaller pore zeolites include ferrierite, and erionite. The second catalyst preferably has the medium or smaller pore zeolite dispersed on a matrix including a binder material such as silica or alumina, and an inert filler material such as kaolin. The second catalyst may also include some other active material such as Beta zeolite. These compositions may have a crystalline zeolite content of about 10-about 50 wt. % or more, and a matrix material content of about 50-about 90 wt. %. Preferably, compositions can contain about 40 wt. % crystalline zeolite material, and those with greater crystalline zeolite content may be used, desirably, if they have satisfactory attrition resistance. Generally, medium and smaller pore zeolites are characterized by having an effective pore opening diameter of less than or equal to about 0.7 nm, rings of 10 or fewer members, and a Pore Size Index of less than 31.

The total mixture may contain about 1-about 25 wt. % of the second catalyst, namely a medium to small pore crystalline zeolite with greater than or equal to about 1.75 wt. % being preferred. When the second catalyst contains about 40 wt. % crystalline zeolite with the balance being a binder material, the mixture may contain about 4-about 40 wt. % of the second catalyst with a preferred content of at least about 7 wt. %. The first catalyst may comprise the balance of the catalyst composition. Usually, the relative proportions of the first and second catalysts in the mixture will not substantially vary throughout the FCC system 100. The high concentration of the medium or smaller pore zeolite as the second catalyst of the catalyst mixture can improve selectivity to light olefins.

Generally, any suitable residence time can be utilized in the at least one riser 160. Preferably, however, a residence time of no more than about 5 seconds, about 3 seconds, about 2 seconds, about 1.5 seconds, about 1 second, or about 0.5 second is utilized. For producing olefins, it is generally desirable for a shorter residence time, e.g., no more than about 1.5 seconds, for converting a stream including one or more $C12^{-}$ olefins. One or more injection points can be provided to offer a variety of residence times on the riser 160. As an example, one or more lower injection points 180 can provide at least one feed having a residence time of about 0.5-about 5 seconds, and one or more upper injection points 170 can provide at least one other feed having a residence time of less than about 0.5 seconds.

The reaction vessel 120 can include one or more separation devices, such as swirl arms 110. Typically, swirl arms 110 separate the catalyst from the one or more hydrocarbon products, such as a gasoline product or a propylene product from the at least one riser 160. Generally, although the swirl arms 110 can separate the catalyst from the hydrocarbon within the reaction vessel 120, reactions may still be ongoing due to contact between at least some of the catalyst and at least some of the hydrocarbon.

Afterwards, this mixture of catalyst and hydrocarbon can enter the disengagement zone 300. Generally, the disengagement zone 300 can include any suitable disengagement device, such as a cyclone separator unit 310. The cyclone separator unit 310 can include any suitable number of cyclones for removing remaining catalyst particles from the product hydrocarbon stream. Thus, the catalyst can be separated and through dip leg conduits 320 dropped to the lower regions of a shell 80. Subsequently, the catalyst can enter the stripping zone 350 via openings 114 in the reaction vessel 120 where the addition of steam can strip absorbed hydrocarbons from the surface of the catalyst by counter-current contact with steam. Such cyclone separators and stripping zones are disclosed in, e.g., U.S. Pat. No. 7,312,370 B2.

Afterwards, the catalyst can continue to flow downward outside the at least one riser 160 within the reaction vessel 120 until it reaches a first catalyst conduit 510, which can transfer catalyst from the at least one reaction vessel 120 to a regeneration zone 500. The regeneration zone 500 can operate at any suitable temperature, such as above 650° C. or other suitable conditions for removing coke accumulated on the catalyst particles. Subsequently, the regenerated catalyst can be returned to the riser 160 via a conduit 520. Any suitable regeneration zone can be utilized, such as those disclosed in, e.g., U.S. Pat. No. 4,090,948 and U.S. Pat. No. 4,961,907.

After the catalyst is regenerated, the catalyst can be provided via the second catalyst conduit 520 to the at least one riser 160. Preferably, the regenerated catalyst is provided upstream of the lines 230, 240, and 250. Generally, the regenerated catalyst can be provided at the base of the at least one riser 160. As an example, a mixing chamber can be provided below the at least one riser 160 that may receive the regenerated catalyst and optionally spent catalyst from the reaction vessel 120. Such a mixing chamber is disclosed in, e.g., U.S. Pat. No. 7,312,370 B2.

The disengagement zone 300 can also provide the one or more hydrocarbon products through a first disengagement conduit 92 and a second disengagement conduit 96 to a plenum 90 of the shell 80. Subsequently, the one or more hydrocarbon products can exit via one or more product streams 390 to the separation zone 400.

Generally, the separation zone 400 can receive the products from the disengagement zone 300. Typically, the separation zone 400 can include one or more distillation columns. Such systems are disclosed in, e.g., U.S. Pat. No. 3,470,084. Usually, the separation zone 400 can produce one or more products, such as a stream 404 rich in ethylene and/or propylene and a stream 408 rich in a gasoline product.

The separation zone 400 may also produce one or more additional streams, such as a recycle stream 412 having an effective amount of one or more $C4^{+}$ olefins, preferably a stream containing one or more C4-C7 olefins. Such an exemplary stream 412 can include one or more C4 hydrocarbons and be recycled to the reaction zone 100. Generally, this stream contains about 10-about 100% olefinic material, preferably about 50-about 90% olefinic material. In one preferred embodiment, the stream can provide at least about 95%, preferably about 95%, and optimally about 99%, by weight of one or more $C4^{-}$ olefins, particularly butene or one or more oligomers of butenes. The separation zone 400 can provide all different types of various fractions via the line 412 to the at least one riser 160. Thus, a variety of feeds can be provided to the at least one riser 160 with, e.g, lighter olefinic feeds being provided at upper feed points 170 to shorten residence times and increase propylene production. Although the separation zone 400 is depicted providing one or more feeds to the at least one riser 160, it should be understood that feeds, independently and whole or in part, can be provided from other sources besides the separation zone 400.

ILLUSTRATIVE EMBODIMENTS

The following examples are intended to further illustrate the subject embodiment(s). These illustrations are not meant to limit the claims to the particular details of these examples. These examples are based circulating FCC pilot plant tests at anticipated commercial conditions. Gas yields, such as hydrogen and light hydrocarbons, e.g., C1-C5, can be determined by passing the total gas volume through a wet test meter with composition determined by a test procedure such as UOP-539-97. Liquid yield can be determined by detailed hydrocarbon analysis using a test procedure such as ASTM D-5134-98, and conversion can be determined by ASTM D2887-06a simulated distillation for liquids separation, e.g., naphtha, light cycle oil, and heavy cycle oil. Density can be determined by, e.g., ASTM D4052-96. Other hydrocarbons, such as paraffins, isoparaffins, olefins, naphthenes, and aromatics may also have yield determined by other suitable procedures.

A commercially available catalyst mixture is utilized having about 8-about 10%, by weight, ZMS-5 zeolite with the balance Y-zeolite having about 1%, by weight, rare earth oxide. A feed of a hydrotreated blend of vacuum and coker gas oils and dilutant nitrogen are utilized. Optionally, a simulated recycled olefin is added. Principal test conditions are a riser outlet temperature of 540° C., an average catalyst/gas oil ratio of about 13, an average riser vapor residence time from about 1.5 to about 2.6 seconds, a riser top pressure of about 280 kPa and a gas oil partial pressure of about 40-about 70 kPa. The gas oil partial pressure can be held constant by reducing the dilutant nitrogen. The yields of C1-C10 hydrocarbons, hydrogen, hydrogen sulfide, cycle oils, and coke based on the net feed rate are determined by the previously mentioned methods and expressed in wt. % of gas oil feed. Recycle olefin runs are made by adding to this feed about 5%, about 10%, and about 20%, by weight pure 1-butene or a pentane-amylene blend consisting of 50% 1-pentene and 50% n-pentane to simulate a second feed of $C4^+$ olefins either recycled from the FCC product recovery section or from an external source feed. The recycle runs are made at the same process conditions as the gas oil only runs, e.g., maintaining constant gas oil partial pressure and vapor residence time by reducing the nitrogen molar flow rate by the amount of the recycle molar flow rate.

Net feed wt. % of the feed only and feed with a simulated olefin recycle are depicted in FIGS. 2-7. Net feed wt. % of a hydrocarbon type is calculated by subtracting the mass flow rate of the hydrocarbon in the recycle stream from the total mass flow rate of that hydrocarbon in the reactor effluent divided by the total feed. As an example, the net feed wt. % of total butene can be calculated as follows:

total butene, wt. % on gas oil feed=(((total butene in reactor effluent(gram/hour))−(total butene recycle(gram/hour)))/(gas oil feed(gram/hour)))*100%

Figure 2:
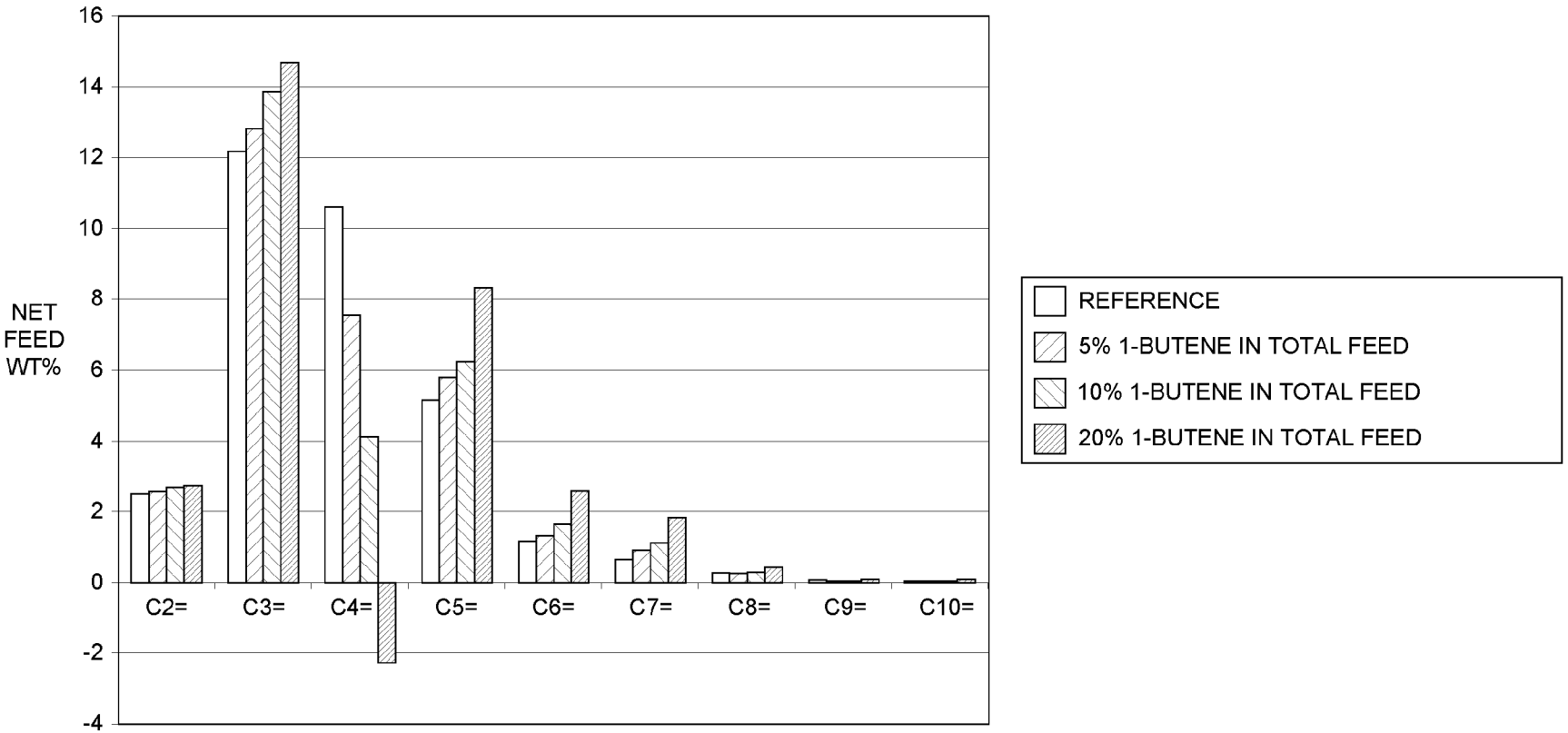
FIG. 2 is a graphical depiction of olefin yields with the addition of 1-butene.
Figure 3:
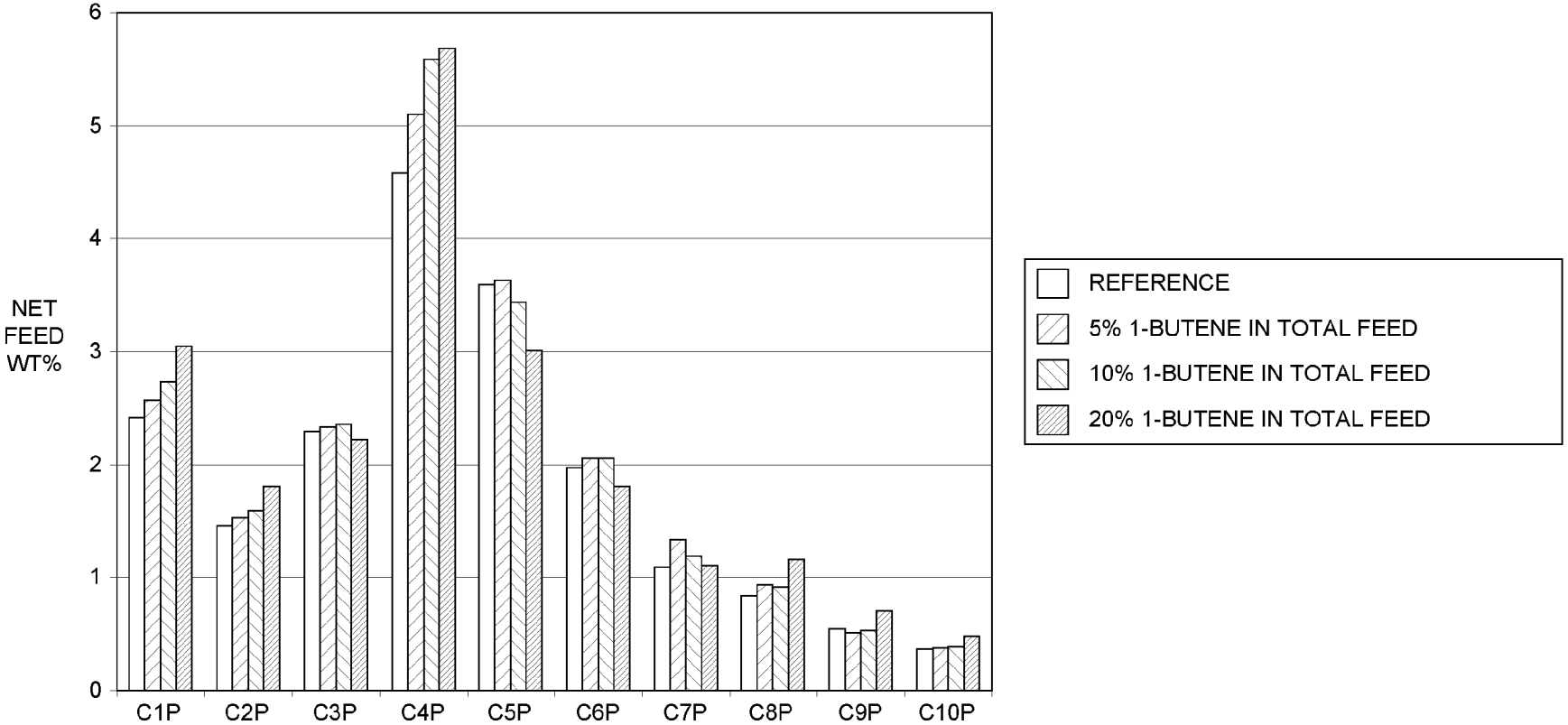
FIG. 3 is a graphical depiction of paraffin yields with the addition of 1-butene.
Figure 4:
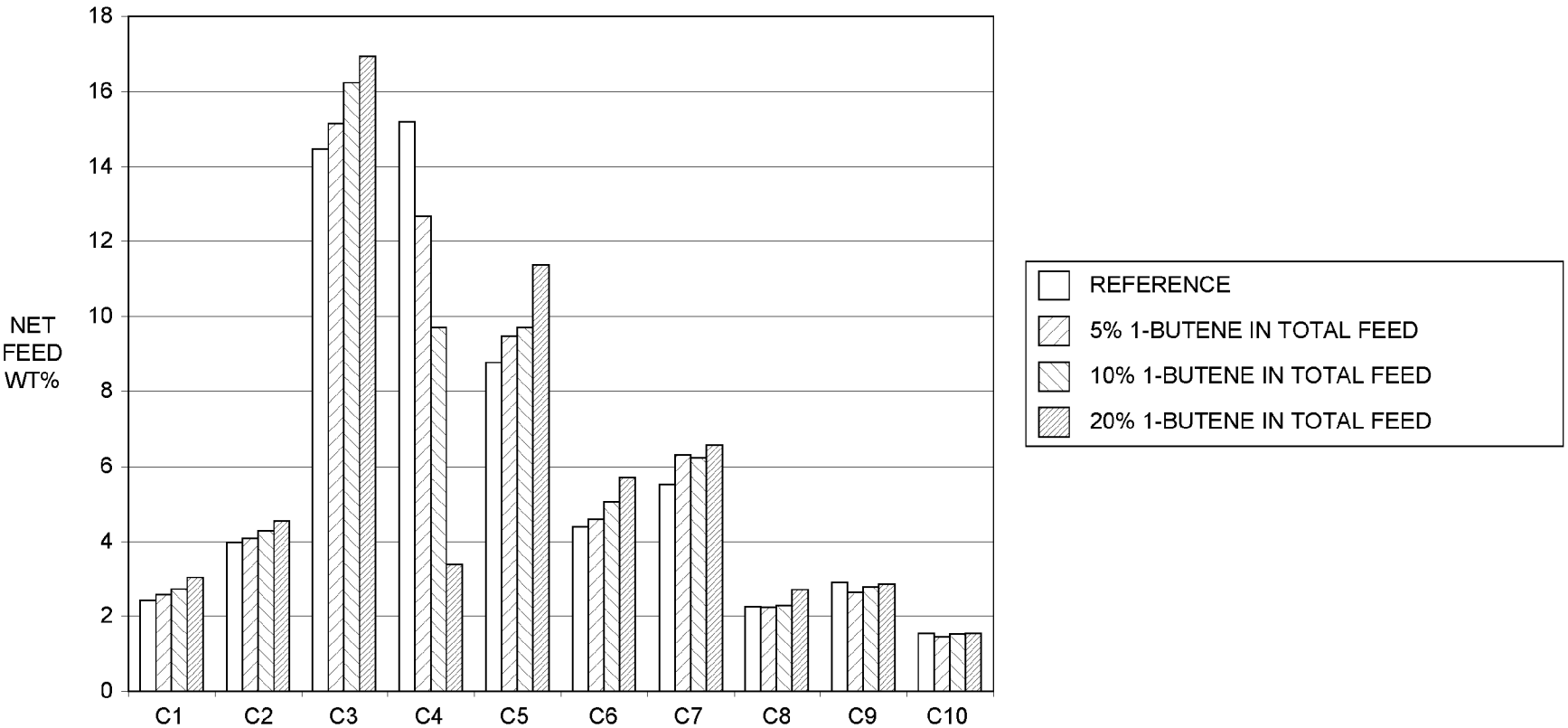
FIG. 4 is a graphical depiction of C1-C10 hydrocarbon yields with the addition of 1-butene.

This calculation can be done for each depicted hydrocarbon, e.g., C3=(as depicted in FIG. 2), C3P (as depicted in FIG. 3), and C3 (as depicted in FIG. 4).

Figure 5:
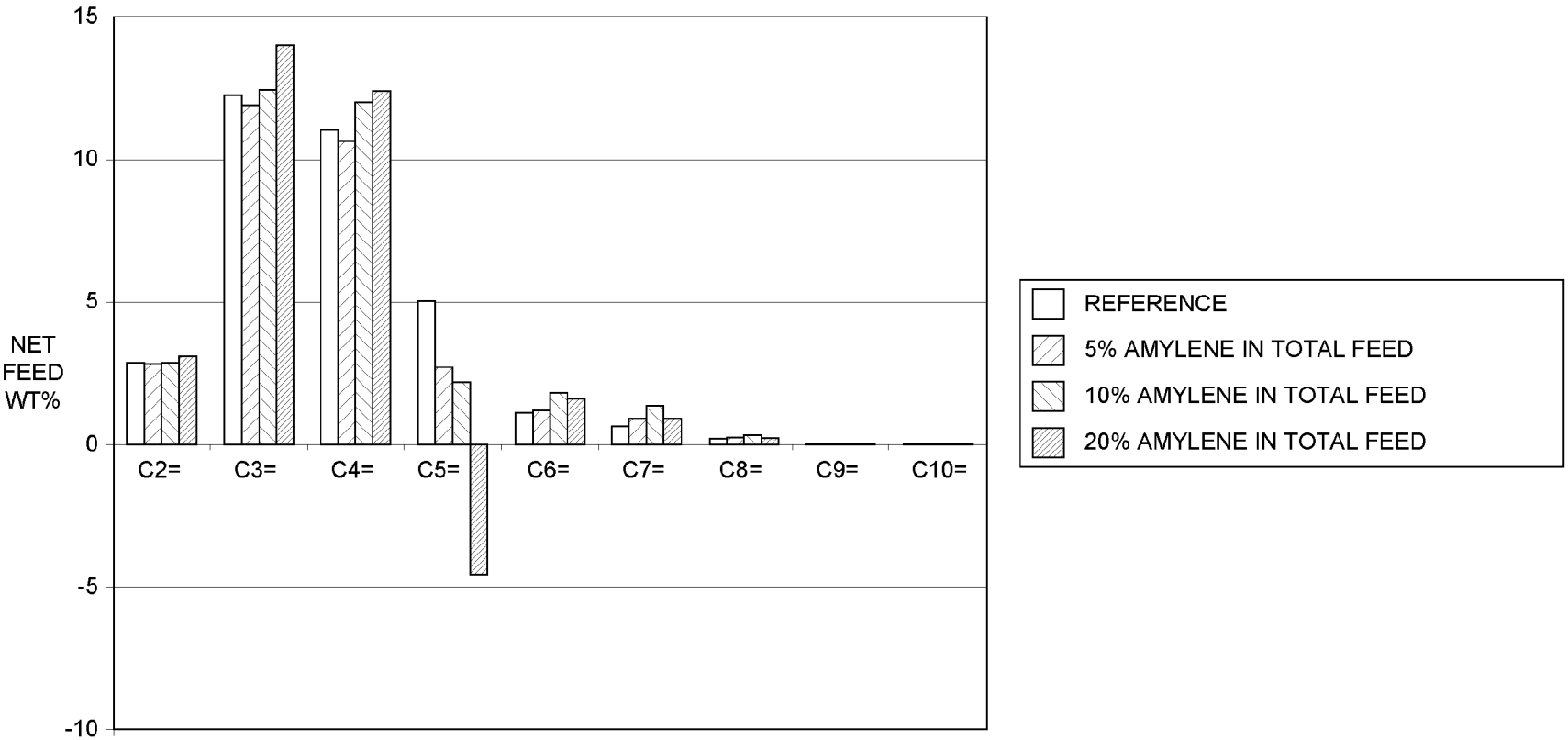
FIG. 5 is a graphical depiction of olefin yields with the addition of amylene.
Figure 6:
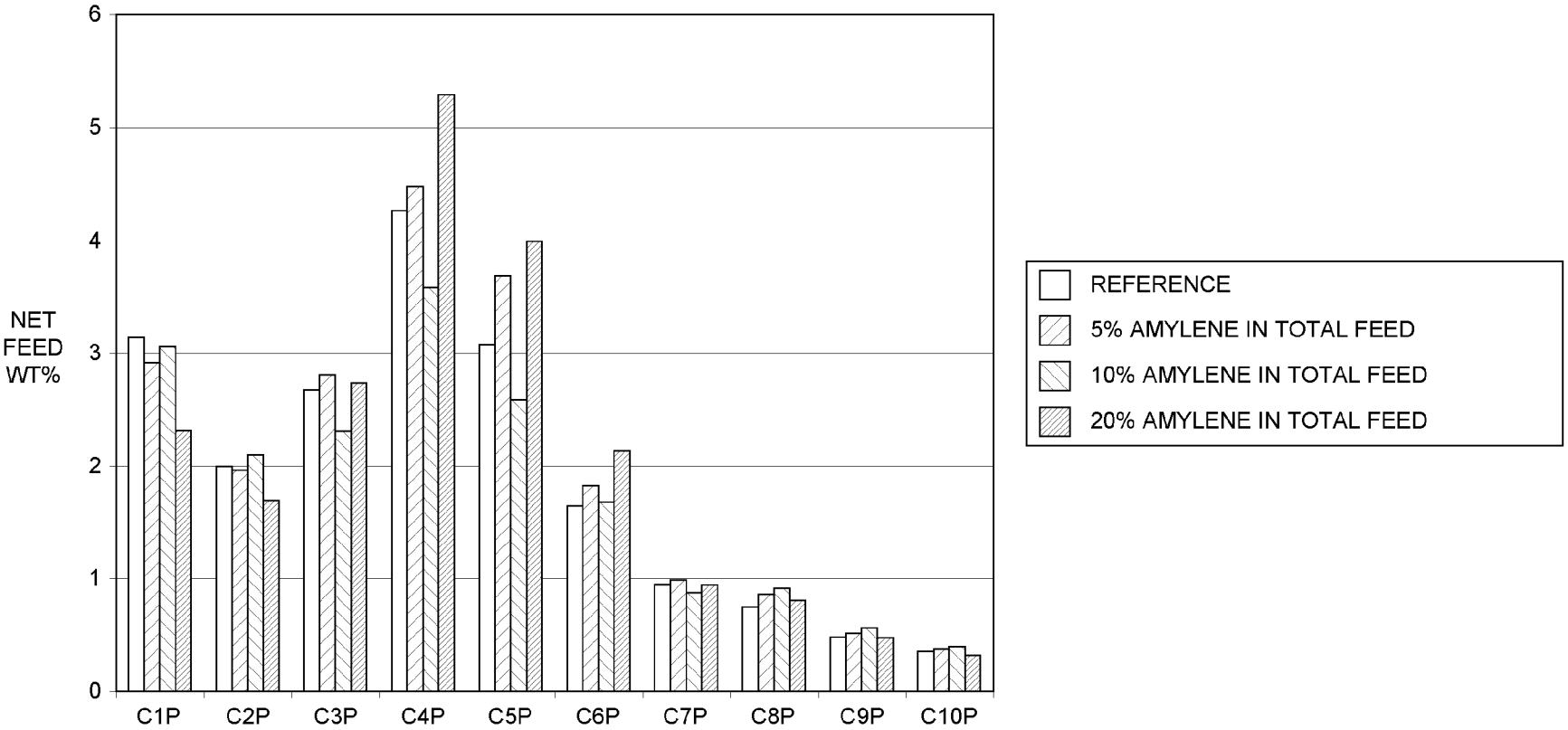
FIG. 6 is a graphical depiction of paraffin yields with the addition of amylene.
Figure 7:
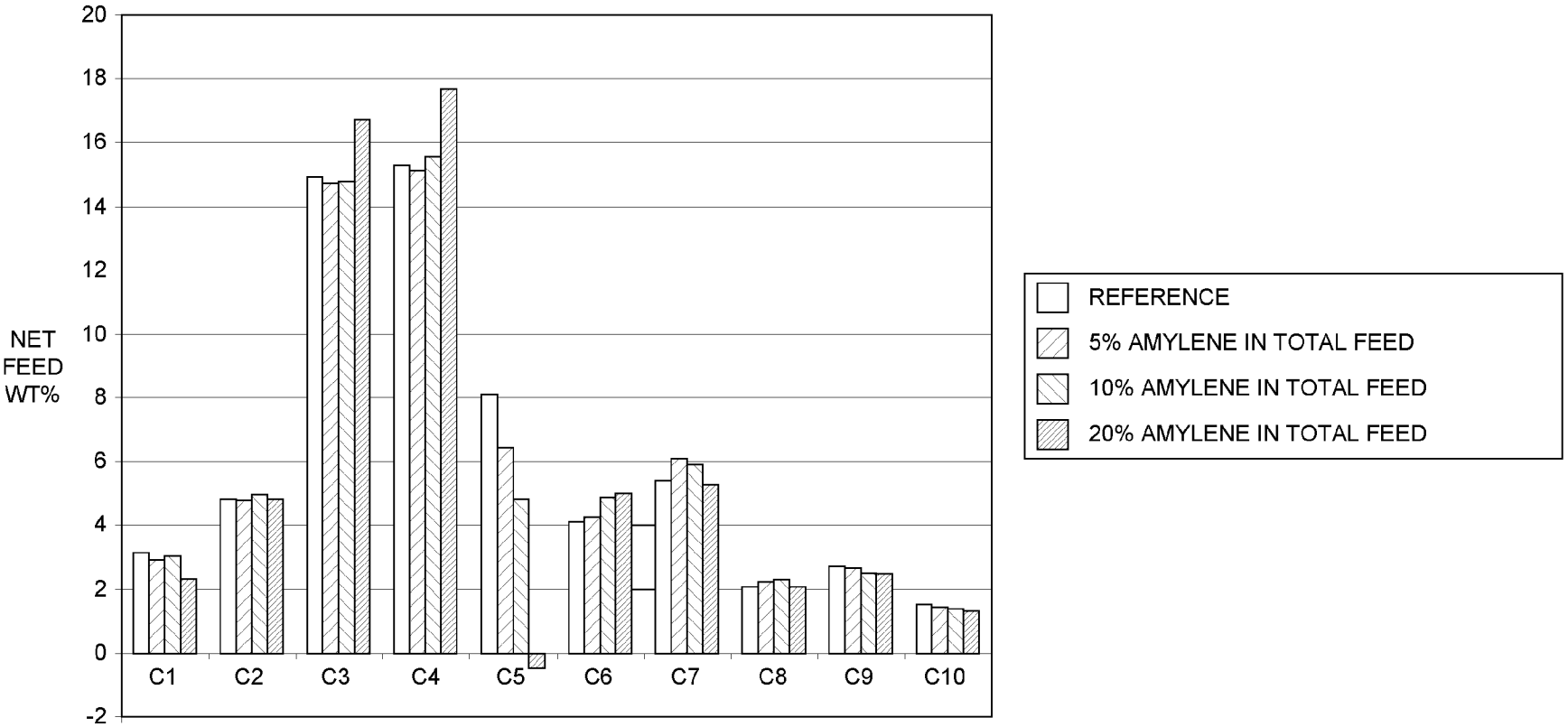
FIG. 7 is a graphical depiction of C1-C10 hydrocarbon yields with the addition of amylene.

Referring to FIGS. 2-4, the addition of 1-butene to the hydrocarbon feed increases propylene production. In addition, an increase of C4 paraffins is also depicted. Generally, the yield of C3 hydrocarbons, particularly propylene, increases as the amount of 1-butene in the total feed increases. As a result, adding 1-butene converts about 60%, by weight, of the recycled 1-butene into propylene, pentenes, hexenes, and paraffins with a minor amount of C1-C2 gases. Referring to FIGS. 5-7, increasing the amount of pentane-amylene at higher levels can also increase the amount of propylene that is produced, as well as producing more C4 paraffins, C3 hydrocarbons, and C4 hydrocarbons.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing, all temperatures are set forth in degrees Celsius and, all parts and percentages are by weight, unless otherwise indicated.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A fluid catalytic cracking system, comprising: a reaction zone comprising at least one riser containing a mixture of a first catalyst having pores with openings greater than about 0.7 nm and a second catalyst having smaller openings than the first catalyst provided by a conduit to the at least one riser, a source of a naphtha stream comprising about 20-about 70%, by weight, of one or more C5-C10 olefin compounds in fluid communication with the at least one riser via a naphtha line, a source of a C4 hydrocarbon stream in fluid communication with the at least one riser via a C4 line, and a source of a feed stream having a boiling point of about 180-about 800° C. in fluid communication with the at least one riser via a feed line; wherein a naphtha stream injection point on the at least one riser for the naphtha line is downstream of a C4 hydrocarbon stream injection point and a feed stream injection point on the at least one riser.

2. The system according to claim 1, further comprising a separation zone wherein the source of the C4 hydrocarbon stream comprises C4 hydrocarbon recycled from the separation zone.

3. The system according to claim 2, wherein the C4 hydrocarbon stream comprises butenes.

4. The system according to claim 3, wherein the C4 hydrocarbon stream comprises at least about 20%, by weight, butenes.

5. The system according to claim 3, wherein the C4 hydrocarbon stream comprises about 50-about 70%, by weight, butenes.

6. A fluid catalytic cracking system, comprising: a reaction zone comprising at least one riser containing a mixture of a first catalyst having pores with openings greater than about 0.7 nm and a second catalyst having smaller openings than the first catalyst provided by a conduit to the at least one riser, a source of a naphtha stream comprising about 20-about 70%, by weight, of one or more C5-C10 olefin compounds in fluid communication with the at least one riser via a naphtha line, a source of a C4 hydrocarbon stream in fluid communication with the at least one riser via a C4 line, and a source of a feed stream having a boiling point of about 180-about 800° C. in fluid communication with the at least one riser via a feed line; wherein a C4 hydrocarbon stream injection point on the at least one riser for the C4 line is downstream of naphtha stream injection point and the feed stream injection point on the at least one riser.

7. The system according to claim 6, further comprising a separation zone wherein the source of the C4 hydrocarbon stream comprises C4 hydrocarbon recycled from the separation zone.

8. The system according to claim 7, wherein the C4 hydrocarbon stream comprises butenes.

9. The system according to claim 8, wherein the C4 hydrocarbon stream comprises at least about 20%, by weight, butenes.

10. The system according to claim 8, wherein the C4 hydrocarbon stream comprises about 50-about 70%, by weight, butenes.

* * * * *